US006550906B2

(12) United States Patent
Ylitalo

(10) Patent No.: US 6,550,906 B2
(45) Date of Patent: Apr. 22, 2003

(54) METHOD AND APPARATUS FOR INKJET PRINTING USING UV RADIATION CURABLE INK

(75) Inventor: Caroline M. Ylitalo, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/000,282

(22) Filed: Nov. 15, 2001

(65) Prior Publication Data

US 2002/0122106 A1 Sep. 5, 2002

Related U.S. Application Data

(60) Provisional application No. 60/259,582, filed on Jan. 2, 2001.

(51) Int. Cl.[7] ..... B41J 2/01
(52) U.S. Cl. ..... 347/102
(58) Field of Search ..... 347/102, 101, 347/104, 105, 106, 107, 43, 4; 399/320; 346/25; 219/216; 101/488; 34/304, 381; 516/70; 8/471

(56) References Cited

U.S. PATENT DOCUMENTS

| | | | |
|---|---|---|---|
| 4,469,026 | A | 9/1984 | Irwin |
| 4,774,523 | A | 9/1988 | Beaufort et al. |
| 5,275,646 | A | 1/1994 | Marshall et al. |
| 5,349,905 | A | 9/1994 | Taylor et al. |
| 5,502,464 | A | 3/1996 | Takahashi et al. |
| 5,508,826 | A | 4/1996 | Lloyd et al. |
| 5,511,477 | A | 4/1996 | Adler et al. |
| 5,530,466 | A | 6/1996 | Fujioka et al. |
| 5,721,086 | A | 2/1998 | Emslander et al. |
| 5,757,407 | A | 5/1998 | Rezanka |
| 5,771,054 | A | 6/1998 | Dudek et al. |
| 5,847,743 | A | 12/1998 | Look |

(List continued on next page.)

FOREIGN PATENT DOCUMENTS

| | | |
|---|---|---|
| EP | 0 134 591 | 3/1985 |
| EP | 0 658 607 | 9/1998 |
| EP | 0 875 382 | 11/1998 |
| EP | 0 889 639 | 1/1999 |
| EP | 0 978 390 | 2/2000 |

(List continued on next page.)

OTHER PUBLICATIONS

Practical Considerations for Using UV Reactive Inks in Piezo DOD Printheads, Richar J. Baker, Spectra Inc., Hanover, New Hampshire, USA, 1999, pp. 111–115.

Noguchi, Hiromichi, Final Program and Proceedings of IS&T's NIP14: International Conference on Digital Printing Technologies, IS&T—The Society for Imaging Science and Technology, Oct. 1998, UV Curable, Aqueous Ink Jet Ink: Material Design and Performance for Digital Printing, pp. 107–110.

56280US003, U.S. Ser. No. 10/001,101, Filed Nov. 15, 2001.

56282US003, U.S. Ser. No. 10/001,144, Filed Nov. 15, 2001.

55435US002, U.S. Ser. No. 09/562,018, Filed May 1, 2000.

*Primary Examiner*—Raquel Yvette Gordon
(74) *Attorney, Agent, or Firm*—James D. Christoff

(57) ABSTRACT

Inkjet printing apparatus includes a print head for directing radiation curable ink toward a substrate and a curing device for directing radiation toward ink received on the substrate. The apparatus includes a computer for determining desired dwell times for the ink based on characteristics of the substrate and the ink. A control device connected to the computer varies the dwell time in accordance with the desired dwell time as determined by the computer.

25 Claims, 3 Drawing Sheets

U.S. PATENT DOCUMENTS

| | | | |
|---|---|---|---|
| 5,875,287 | A | 2/1999 | Li et al. |
| 5,981,113 | A | 11/1999 | Christian |
| 6,039,426 | A | 3/2000 | Dobbs |
| 6,082,911 | A | 7/2000 | Murakami |
| 6,092,890 | A | 7/2000 | Wen et al. |
| 6,114,022 | A | 9/2000 | Warner et al. |
| 6,145,979 | A | 11/2000 | Caiger et al. |
| 6,248,404 | B1 | 6/2001 | Greene-Mathis |

FOREIGN PATENT DOCUMENTS

| | | |
|---|---|---|
| EP | 1 034 936 | 9/2000 |
| EP | 1 046 511 | 10/2000 |
| EP | 1 108 553 | 6/2001 |
| GB | 2 142 579 | 1/1985 |
| GB | 2 233 928 | 1/1991 |
| GB | 2 322 597 | 9/1998 |
| GB | 2 338 212 | 12/1999 |
| JP | 62109645 | 5/1987 |
| JP | HEI 1-133746 | 5/1989 |
| JP | 02092642 | 4/1990 |
| JP | 6-200204 | 7/1994 |
| JP | 8218016 | 8/1996 |
| JP | 8218017 | 8/1996 |
| JP | 8218018 | 8/1996 |
| JP | 10-207978 | 7/1998 |
| JP | 11-070645 | 3/1999 |
| JP | 200211219 | 8/2000 |
| WO | WO97/04964 | 2/1997 |
| WO | WO97/27053 | 7/1997 |
| WO | WO97/31071 | 8/1997 |
| WO | WO99/08875 | 2/1999 |
| WO | WO99/29788 | 6/1999 |
| WO | WO00/73083 | 12/2000 |
| WO | WO01/17780 | 3/2001 |

METHOD AND APPARATUS FOR INKJET PRINTING USING UV RADIATION CURABLE INK

This application is a Provisional Application Ser. No. Claims Benefit of No. 60/259,582 filed on Jan. 2, 2001.

BACKGROUND OF THE INVENTION

1. Field of the Invention

This invention relates to inkjet printing apparatus and methods for inkjet printing using ink that is curable upon exposure to actinic radiation such as UV radiation. More particularly, the present invention is directed to automated methods and apparatus for optimizing the quality of an image obtained by using an inkjet printer and radiation curable ink.

2. Description of the Related Art

Inkjet printing has increased in popularity in recent years due to its relatively high speed and excellent image resolution. Moreover, inkjet printing apparatus used in conjunction with a computer provides great flexibility in design and layout of the final image. The increased popularity of inkjet printing and the efficiencies in use have made inkjet printing an affordable alternative to previously known methods of printing.

In general, there are three types of inkjet printers in widespread use: the flat bed printer, the roll-to-roll printer and the drum printer. In the flat bed printer, the medium or substrate to receive the printed image rests on a horizontally extending flat table or bed. An inkjet print head is mounted on a movable carriage or other type of mechanism that enables the print head to be moved along two mutually perpendicular paths across the bed. The print head is connected to a computer that is programmed to energize certain nozzles of the print head as the print head traverses across the substrate, optionally using inks of different colors. The ink on the substrate is then cured as needed to provide the desired final image.

In roll-to-roll inkjet printers, the substrate to receive the printed image is commonly provided in the form of an elongated web or sheet and advances from a supply roll to a take-up roll. At a location between the supply roll and the take-up roll, a print head is mounted on a carriage that is movable to shift the print head across the substrate in a direction perpendicular to the direction of advancement of the substrate. Known roll-to-roll inkjet printers include vertical printers, wherein the substrate moves in an upwardly direction past the print head, as well as horizontal printers, wherein the substrate moves in a horizontal direction past the print head.

Drum inkjet printers typically include a cylindrical drum that is mounted for rotational movement about a horizontal axis. The substrate is placed over the periphery of the drum and an inkjet print head is operable to direct drops of ink toward the substrate on the drum. In some instances, the print head is stationary and extends along substantially the entire length of the drum in a horizontal direction. In other instances, the length of the print head is somewhat shorter than the length of the drum and is mounted on a carriage for movement in a horizontal direction across the substrate.

Inks that are commonly used in inkjet printers include water-based inks, solvent-based inks and radiation-curable inks. Water-based inks are used with porous substrates or substrates that have a special receptor coating to absorb the water. In general, water-based inks are not satisfactory when used for printing on non-coated, non-porous films.

Solvent-based inks used in inkjet printers are suitable for printing on non-porous films and overcome the problem noted above relating to water-based ink. Unfortunately, many solvent-based inks contain about 90 percent organic solvents by weight. As solvent-based inks dry, the solvent evaporates and may present an environmental hazard. Although environmental systems may be available for reducing the emission of solvents to the atmosphere, such systems are generally considered expensive, especially for the owner of a small print shop.

Furthermore, inkjet printers using either solvent-based inks or water-based inks must dry relatively large quantities of solvent or water before the process is considered complete and the resulting printed product can be conveniently handled. The step of drying the solvents or water by evaporation is relatively time-consuming and can be a rate limiting step for the entire printing process.

In view of the problems noted above, radiation-curable inks have become widely considered in recent years as the ink of choice for printing on a wide variety of non-coated, non-porous substrates. The use of radiation curing enables the ink to quickly cure (commonly considered as "instant" drying) without the need to drive off large quantities of water or solvent. As a result, radiation curable inks can be used in high speed inkjet printers that can achieve production speeds of over 1000 $ft^2$/hr (93 $m^2$/hr.)

Inkjet printers that are capable of printing on relatively large substrates are considered expensive. Accordingly, it is desired to use the same printer to impart images to a wide variety of substrates using a wide variety of ink compositions if at all possible. Moreover, it is preferred that each image printed by such printers be of high quality on a consistent basis regardless of the type of substrate and the type of ink used, in view of the time and expense of reprinting the image in instances where the quality of the image is less than desired.

From a practical standpoint, many print shops use the same type of ink on a variety of different substrates, since a considerable amount of time might otherwise be needed to change from one type of ink to another. However, ink of a given formulation may interact differently with different types of substrates. It is possible that the quality of the final printed image may be significantly impaired when the composition of the substrate is changed from one type to another.

The printer operator is often provided with little guidance as to the selection of process parameters that will provide the best image quality for any combination of ink and substrate. Today, many operators use a manual trial-and-error methodology in an attempt to optimize the parameters of the printing process. For example, the operator may print a number of images and vary the curing time or temperature of the curing device. Once the images have cured, the operator visually reviews each image for image quality in order to help select an optimal temperature and/or curing time.

Skilled operators of inkjet printers tend to accumulate over time a knowledge of preferred printing parameters for use when certain combinations of ink and substrate are selected. Unfortunately, this wealth of knowledge cannot be readily passed along to newer operators who are relatively unskilled in the art of inkjet printing. Consequently, it would be desirable to provide an automated method and apparatus for inkjet printers that would consistently enable high quality images to be printed without undue reliance upon the operator's skill and level of experience.

SUMMARY OF THE INVENTION

The present invention is directed toward automated methods and apparatus for selecting process parameters used in inkjet printing with radiation curable ink such as ultraviolet "UV" radiation curable ink. Preferred dwell times for certain combinations of selected inks and selected substrates are stored in computer memory and recalled as needed. A control device varies the dwell time in order to provide the desired result.

In more detail, the present invention is directed in one aspect to inkjet printing apparatus for curable ink that comprises a support for receiving a substrate and a print head for directing radiation curable ink toward a substrate received on the support. The apparatus also includes a curing device for directing radiation toward ink received on the substrate, and a controller having an input for receiving one or more characteristics of the substrate and one or more characteristics of the ink. The controller includes a computer for determining a desired dwell time for the ink based on the characteristics of the substrate and the ink. The apparatus further includes a control device connected to the computer for varying the dwell time in accordance with the desired dwell time determined by the computer.

The present invention is directed in another aspect toward a method of inkjet printing. The method includes the acts of selecting a radiation curable ink and selecting a substrate. The method also includes the act of entering at least one characteristic of the ink and at least one characteristic of the substrate into a computer. The method further includes the act of determining a preferred ink dot gain when the selected ink is printed onto the selected substrate, and calculating with the computer a dwell time for achieving the preferred ink dot gain.

These and other aspects of the invention are described in more detail below and are illustrated in the accompanying drawings.

DETAILED DESCRIPTION OF THE PREFERRED EMBODIMENTS

The following examples describe various types of inkjet printing apparatus and printing methods according to the present invention. The accompanying drawings are schematic illustrations selected to highlight certain aspects of the invention. In practice, the concepts described below may be adapted for use with a variety of inkjet printers, including many commercially available inkjet printers.

Examples of suitable rotating drum type inkjet printers include "PressJet" brand printers from Scitex (Rishon Le Zion, Israel) and "DryJet" brand Advanced Digital Color Proofing System from Dantex Graphics Ltd. (West Yorkshire, UK). Examples of flat bed type inkjet printers include "PressVu" brand printers from VUTEk Inc. (Meredith, N.H.) and "SIAS" brand printers from Siasprint Group (Novara, Italy). Examples of roll-to-roll inkjet printers include "Arizona" brand printers from Raster Graphics, Inc. of Gretag Imaging Group (San Jose, Calif.) and "UltraVu" brand printers from VUTEk Inc.

Figure 1:
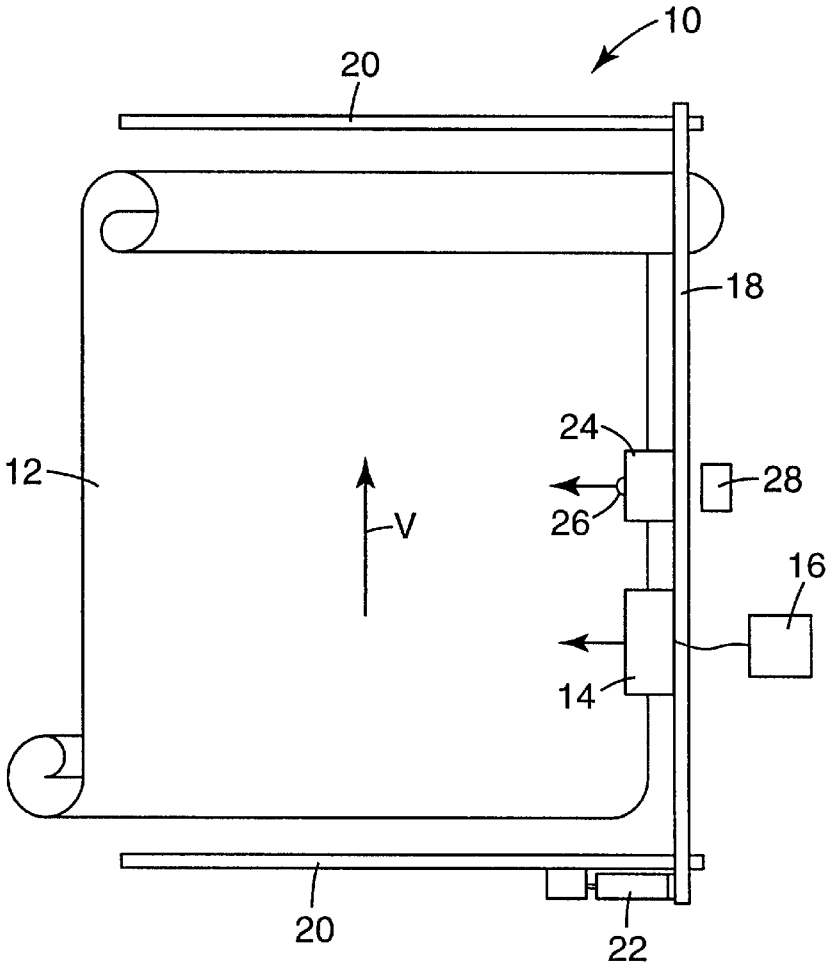
FIG. 1 is a schematic, perspective view showing a portion of an inkjet printing apparatus according to one embodiment of the present invention, wherein the apparatus in this instance is a roll-to-roll vertical inkjet printer.

FIG. 1 illustrates certain components of an inkjet printing apparatus 10 that has been constructed and arranged according to one embodiment of the present invention. The apparatus 10 depicted in FIG. 1 is a roll-to-roll vertical inkjet printer, and the supply roller and the take-up roller are not shown. However, the supply roller and the take-up roller function as a transport system for the substrate 12 and are operable to move a substrate 12 in an upwardly direction as indicated by the arrow "V" in FIG. 1.

A vertical plate is located behind the substrate 12 as it moves in an upwardly direction, and functions as a support for receiving the substrate 12. An inkjet print head 14 extends across the plate and is operable to direct radiation curable ink such as ultraviolet ("UV") radiation curable ink onto the substrate 12 as it moves across the plate. Preferably, the print head 14 comprises a bank of print heads for simultaneously printing ink of different colors.

For example, the print head 14 may include a first set of nozzles that are in fluid communication with a first source of ink of a certain color and a second set of nozzles that are in communication with a second source of ink of a different color. Preferably, the print head 14 has at least four sets of nozzles that are in communication with at least four corresponding ink sources. As a result, the print head 14 is operable to simultaneously print at least four inks of different colors so that a wide color spectrum in the final printed image can be achieved.

Optionally, the print head 14 includes an additional set of nozzles that is in communication with a source of clear ink or other material that lacks color. The clear ink can be printed on the substrate 12 before any colored ink is applied, or can be printed over the entire image. Printing clear ink over the entire image can be used to improve performance of the finished product, such as by improving durability, gloss control, resistance to graffiti and the like.

The print head 14 is electrically coupled to a controller 16 for selective activation when desired. Preferably, the controller 16 also controls movement of a drive system (not shown) for moving the substrate 12 along its path of travel from the supply roller to the take-up roller. The drive system is part of the transport system and optionally comprises an electric stepping motor for incrementally advancing the substrate 12 as desired.

The print head 14 is mounted on a carriage 18 for movement across the substrate 12 during a printing operation. In this embodiment, the carriage 18 is movable in a horizontal direction across the width of the substrate 12 to print a row of dots of the desired image. Once the print head 14 transverses across the entire width of the substrate 12, the transport system advances the substrate 12 and the carriage 18 moves the print head 14 in an opposite direction across the substrate 12 for printing the next row of dots of the desired image.

The carriage 18 is movable along two rails 20 that extend in parallel, horizontal directions. A stepping motor 22 is operable to shift the carriage 18 along the rails 20. The motor 22 is connected to the controller 16 for timed, selective activation of the motor 22 as may be needed.

A curing device 24 is also mounted on the carriage 18. The curing device 24 may include one or more sources of radiation, each of which is operable to emit light in the ultraviolet and/or visible spectrum. Suitable sources of UV radiation include mercury lamps, xenon lamps, carbon arc lamps, tungsten filament lamps, lasers and the like.

Optionally, the sources of radiation are lamps of a type commonly known as "instant-on, instant-off" lamps so that the time that the radiation reaches the substrate can be precisely controlled. In the embodiment of the invention that is shown in the drawings, the curing device 24 includes a single UV lamp 26. Preferably, the lamp 26 is masked to direct radiation when activated only to a certain portion of the substrate 12. For example, the curing device 24 may include a shield that extends substantially over the UV lamp 26. The shield has an opening for directing radiation only to a portion of the substrate 18 that lies directly beneath the lamp 26.

The curing device 24 is electrically connected to the controller 16 for activation and deactivation of the lamp 26. Additionally, the curing device 24 is shiftably mounted on the carriage 18 for movement in a vertical direction. A control device such as an electric stepping motor 28 is connected to the curing device 24 for moving the latter along the longitudinal axis of the carriage 18 in a direction either toward or away from the print head 14. The motor 28 is electrically connected to the controller 16 for energization as may be needed.

The controller 16 has an input for receiving one or more characteristics of the substrate 12 and one or more characteristics of the ink that is supplied to the print head 14. The controller 16 also includes a computer for determining a desired dwell time for the ink based on the characteristics of the selected substrate and the selected ink. Preferably, the computer is connected to a user interface output device such as a visual display or monitor as well as a user interface input device such as a keyboard and/or mouse for inputting characteristics as may be desired.

The computer may include software capable of a variety of functions. For example, the computer may include software that displays various drop-down menus on the monitor. In one drop-down menu, a number of different types of substrates are identified. In another drop-down menu, a number of different inks are identified. Optionally, the software defaults to the previous selections of substrate and ink that were provided by the operator.

The computer determines a desired dwell time for the ink based on the characteristics of the substrate 12 and the ink. Characteristics of the substrate 12 may include, for example, the composition of the substrate 12 and/or physical characteristics of the substrate 12 such as surface roughness, temperature, surface energy, porosity, color, and diffusion rate through the substrate of various solvents and monomers. Characteristics of the ink may include, for example, the composition of the ink and/or physical characteristics of the ink such as viscosity, elasticity, surface tension, temperature, and its diffusion coefficient in various substrates. Preferably, the computer software may identify selected inks and selected substrates by brand name, trade name, catalog number, inventory number or the like. Alternatively, the operator may input characteristics regarding the substrate and the ink in response to a series of prompts.

In addition, the software may contain a warning function to alert the operator whenever certain combinations of ink and substrate selected by the operator are known to be incompatible or otherwise known to provide poor results. Optionally, the software utilizes characteristics of the desired image in determining the desired dwell time and/or determining whether or not an alert signal should be sent to the operator. Examples of image characteristics include image gloss (i.e., gloss finish or matte finish), presence of an overcoat, and whether or not the image will be used in backlit application. For example, the software may provide a warning to the operator that a certain overcoat should not be applied to certain substrates, or that the selected ink/substrate combination will not result in acceptable backlit graphic density.

The dwell time for the ink preferably represents the time interval between the time that the ink is received on the substrate 12 and the time that the ink on the substrate 12 receives radiation from the curing device 24. For UV curable inks, it can be assumed that the ink is substantially cured once it has received actinic radiation, and that further spreading or leveling on the substrate 12 or further diffusion into the substrate 12, if any, will not occur. In practice, the time interval for the dwell time may be assumed to begin at the time of activation (or deactivation) of the print head 14 and end at the time of activation of the UV lamp 26.

Once the desired dwell time is selected by the computer, the motor 28 is energized as necessary to shift the curing device 24 either toward or away from the print head 14. If, for example, the curing device 24 is moved in an upwardly direction away from the print head 14, the dwell time is increased for any given speed of movement of the substrate 12. On the other hand, the dwell time is decreased for any given speed of movement of the substrate 12 by moving the curing device 24 in a downwardly direction toward the print head 14.

Preferably, the computer software retains in memory certain information regarding preferred, optimal dwell times for given combinations of substrates and inks. Optionally, this information is supplied by the manufacturer of the ink, the substrate and/or the printer. As a consequence, the software need only recall the information from memory when needed. The control device or motor 28 can then be quickly activated to adjust the spacing between the print head 14 and the UV lamp 26 in order to provide the desired dwell time during a printing operation.

Preferred dwell times may be chosen, for example, by determining the maximum gain in size of the ink dot once the drop has contacted the substrate 12. Optionally, the upper limit of the desired dot size may be less than the maximum dot size that might be attained over an extended period of time. For example, the desired dwell time may be based on the time needed for the printed dot to reach its maximum size or reach a size that gives the desired dot gain for the selected printer resolution, whichever condition occurs first.

The selection of a proper dwell time can significantly affect the quality of the final printed image. If, for example, a dot of ink is cured too soon, the ink may not have sufficient time to spread, resulting in conditions known as banding and poor solid fill. Curing too soon also may cause insufficient leveling of the ink layer, resulting in an image having grainy texture and poor gloss or a "matted" appearance. On the other hand, if the dwell time is too large, the ink dots may tend to spread excessively on the surface of the substrate 12, resulting in poor edge definition of the printed image. Excessive dwell times may also cause a mottled appearance due to surface tension driven coalescence of the deposited ink drops on the substrate 12.

As an alternative, the dwell time may be varied by changing the speed of advancement of the substrate 12 as it moves from the supply roller to the take-up roller. In this alternative, the motor 28 for shifting the curing device 24 is not needed. Instead, the control device for varying the dwell time comprises an electronic or mechanical speed control or timed delay for the transport system of the apparatus 10, so that the velocity of movement of the substrate relative to the curing device 24 (and hence the time interval between printing and curing) can be changed as needed. However, use of the motor 28 as described above for changing the dwell time is preferred, since the output printing speed of the apparatus 10 (in terms of, for example, square feet per hour of finished product) need not be reduced.

The substrate 12 may be made of any suitable material that is compatible with the selected ink and exhibits satisfactory characteristics once placed in use in a desired location. Examples of suitable substrates 12 include both porous and nonporous materials such as glass, wood, metal, paper, woven and non-woven materials and polymeric films. Nonlimiting examples of such films include single and multi-layer constructions of acrylic-containing films, poly (vinyl chloride)-containing films, (e.g., vinyl, plasticized vinyl, reinforced vinyl, vinyl/acrylic blends), urethane-containing films, melamine-containing films, polyvinyl butyral-containing films, and multi-layered films having an image reception layer comprising an acid- or acid/acrylate modified ethylene vinyl acetate resin, as disclosed in U.S. Pat. No. 5,721,086 (Emslander et al.) or having an image reception layer comprising a polymer comprising at least two monoethylenically unsaturated monomeric units, wherein one monomeric unit comprises a substituted alkene where each branch comprises from 0 to about 8 carbon atoms and wherein one other monomeric unit comprises a (meth)acrylic acid ester of a nontertiary alkyl alcohol in which the alkyl group contains from 1 to about 12 carbon atoms and can include heteroatoms in the alkyl chain and in which the alcohol can be linear, branched, or cyclic in nature.

Optionally, one side of the film opposite the printed side includes a field of pressure sensitive adhesive. Usually, the field of adhesive on one major surface is protected by a release liner. Moreover, the films can be clear, translucent, or opaque. The films can be colorless, a solid color or a pattern of colors. The films can be transmissive, reflective, or retroreflective. Commercially available films known to those skilled in the art include the multitude of films available from 3M Company under the trade designations PANAFLEX, NOMAD, SCOTCHCAL, SCOTCHLITE, CONTROLTAC, and CONTROLTAC-PLUS.

Commercially available UV radiation curable inks that can be used include SUNJET brand inks from Sun Chemicals Corp. (Fort Lee, N.J.), XaarJet brand inks from Xaar Ltd. (Cambridge, UK), and ARROWJET brand inks from Flint Ink (Flint, Mich.). Other radiation curable inks that can be used are inks that cure when exposed to radiation in the visible spectrum or when exposed to an electron beam.

Figure 2:
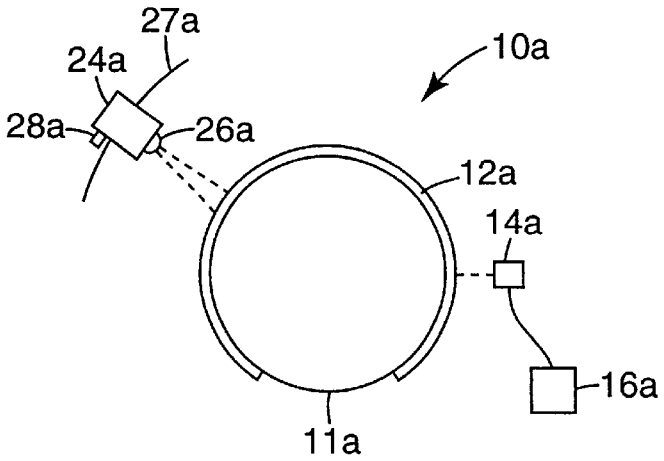
FIG. 2 is a schematic end elevational view of an inkjet printing apparatus according to another embodiment of the present invention, wherein the apparatus in this embodiment is a rotatable drum inkjet printer.

Another embodiment of the invention is schematically illustrated in FIG. 2, wherein an apparatus 10*a* comprises a rotatable drum inkjet printer. The apparatus 10*a* includes a cylindrical support or drum 11*a* that is rotatable about a central horizontal reference axis. The drum 11*a* is coupled to a transport system such as an electric motor for moving the drum 11*a* about its central axis, and the motor is connected to a controller 16*a* for controlled movements of the drum 11*a*. A substrate 12*a* is received over the external surface of the drum 11*a*.

The apparatus 10*a* also includes a print head 14*a* for directing UV radiation curable ink onto the substrate 12*a*. The print head 14*a* is somewhat similar to the print head 14, in that the print head 14*a* is preferably connected to multiple sources of ink of different colors and has a number of nozzles that are in communication with the ink sources. In addition, the print head 14*a* is connected to the controller 16*a* for selective activation when desired.

As one option, the length of the print head 14*a* may be substantially equivalent to the axial length of the drum 11*a*. As another option, the length of the print head 14*a* may be shorter than the length of the drum 11*a*. In the latter embodiment, the print head 14*a* is mounted on a carriage (not shown) for movement along a horizontal axis. The carriage is connected to a drive means (such as, for example, a stepping motor) and the drive means is connected to the controller 16*a* for selective movement. Movement of the print head 14*a* enables the substrate 12*a* to be printed across its entire width as may be desired.

The apparatus 10*a* also includes a curing device 24*a* for directing UV radiation toward ink that is received on the substrate 12*a*. The curing device 24*a* is somewhat similar to the curing device 24 and includes a UV lamp 26*a* that is preferably of a type commonly known as an "instant-on, instant-off" lamp. The lamp 26*a* is connected to the controller 16*a* for activation and deactivation as needed.

The curing device 24*a* is coupled to a pair of guide rails 27*a,* one of which is shown in FIG. 2. The rails 27*a* extend in an arc about the rotational axis of the drum 12*a*. A motor 28*a,* such as an electric stepping motor, is operably connected to the curing device 24*a* and the rails 27*a* for moving of the curing device 24*a* along the rails 27*a* as desired. The motor 28*a* is also connected to the controller 16*a* for operation.

As can be appreciated by reference to FIG. 2, the motor 28*a* is operable to move the UV lamp 26*a* in directions either toward or away from the print head 14*a*. As such, the dwell time of ink received on the substrate 12*a* can be varied by operation of the motor 28*a*. The motor 28*a* consequently functions as a control device connected to the controller 16*a* for varying the dwell time in accordance with the desired dwell time as determined by a computer of the controller 16*a*.

Alternatively, the dwell time may be varied by changing the start and stop times of rotational movement of the drum 11*a*. In this alternative, the electric motor for moving the drum 11*a* functions as a control device for varying the dwell time. The controller 16*a* determines the appropriate stop and start times, so that the freshly printed ink dots are exposed to UV radiation at the appropriate time.

A number of other options are also possible. For example, a curing device of an inkjet printer may be shifted relative to the print head of the printer by the options described in applicant's pending U.S. patent application Ser. No. 09/562,018, filed May 1, 2000 and entitled "RADIATION CURING SYSTEM AND METHOD FOR INKJET PRINTERS". Other options for varying the dwell time used in rotatable drum inkjet printers are described in applicant's co-pending patent application entitled "ROTATABLE DRUM INKJET PRINTING APPARATUS FOR RADIATION CURABLE INK", Ser. No. 10/001,101 and filed on even date herewith. Methods and apparatus for varying the intensity of the radiation emitted from a UV radiation source may also be provided, such as the methods and apparatus described in applicant's co-pending U.S. patent application entitled "METHOD AND APPARATUS FOR SELECTION OF INKJET PRINTING PARAMETERS"; Ser. No. 10/001,144 filed Nov. 15, 2001 and filed on even date herewith. All of these patent applications, as well as any other patents or patent applications referred to herein, are expressly incorporated by reference into the present application.

The invention is also useful for optimizing the time delay between printing and curing based upon the type of image printed. Optimum dot gain for a graphic image is less than that for a solid fill type image (such as a traffic sign). A graphic image needs less dot gain for fine details, while a solid fill image could benefit from a larger dot gain for less banding and more uniform fill. The present invention enables high quality images to be produced for both graphic images and traffic signs applications on a single printer.

As set out above, the present invention provides a means for automatically varying the dwell time for inkjet printers in accordance with the characteristics of a selected combination of ink and substrate. The examples below illustrate suitable dwell times for certain substrates using a particular ink. Those examples may be followed for use in developing preferred dwell times for other combinations of particular inks and substrates.

EXAMPLE 1

The spread of an ink dot is measured as a function of time for magenta ink on various substrates. The ink was prepared by first preparing a millbase from 40 percent by weight magenta pigment (Monastral Red RT-343-D from Ciba Specialty Chemicals of Tarrytown, N.Y.), 14 percent by weight of dispersant ("SOLSPERSE 32000" from Zeneca Inc. of Wilmington, Del.") and 46 percent by weight of tetrahydrofurfuryl acrylate. To prepare the millbase, the Solsperse dispersant was dissolved in the tetrahydrofurfuryl acrylate. The pigment was then added to the solution and incorporated by mixing with a rotor-stator mixer. The dispersion was milled using a Netszch Mini-Zata bead mill (available from Netszch Inc. of Exton, Pa.) using 0.5 mm zircona media. The dispersion was processed for 90 minutes in the mill.

An oligomer was prepared according to the following procedure: 281.3 g TONE M-100 polycaprolactone acrylate, available from Union Carbide Corp. of Danbury, Conn., (0.818 equivalents) was added to 0.040 g 2,6-di-tert-butyl-4-methyl phenol (BHT) and 1 drop dibutyltin dilaurate (both available from Aldrich Chemical Co. of Milwaukee, Wis.). This was heated with stirring under an atmosphere of dry air to 90° C. 84.2 g VESTANAT TMDI mixture of 2,2,4-trimethylhexamethylene diisocyanate and 2,4,4-trimethylhexamethylene diisocyanate (0.80 equivalents), available from Creanova Inc. of Somerset, N.J., were added slowly, controlling the exotherm to under 100° C. with a water bath. The reaction was held at 90° C. for 8 hours, whereupon the IR spectrum showed no residual isocyanate. The Brookfield viscosity of the product was determined to be 2500 CP 25° C. The calculated molecular weight of this material was 875.

The millbase and oligomer were combined with the remaining ingredients in the following proportions: 80 grams millbase, 40 grams oligomer, 28.5 grams tetrahydrofurfuryl acrylate, 24.1 grams 2-(2-ethoxyethoxy)ethyl acrylate, 60 grams isobornyl acrylate, 40 grams isooctyl acrylate, 60 grams N-vinylcaprolactam, 20 grams hexanediol diacrylate, 8 grams stabilizer (TINUVIN 292 from Ciba Specialty Chemicals), 3.6 grams 2,2',6,6'-tetraisopropyldiphenyl carbodiimide (STABAXOL I from Rhein Chemie Corp of Trenton, N.J.), 0.4 gram stabilizer (IRGANOX 1035 from Ciba Specialty Chemicals), 14 grams bis(2,4,6-trimethylbenzoyl)phenylphosphine oxide (IRGACURE 819 from Ciba Specialty Chemicals), 12 grams 2,2-dimethoxy-1,2-diphenylethan-1-one (IRGACURE 651 from Ciba Specialty Chemicals), 8 grams 2-benzyl-2-dimethylamino-1-(4-morpholinophenyl)butan-1-one (IRGACURE 369 from Ciba Specialty Chemicals), and 4 grams isopropylthioxanthone (SPEEDCURE ITX from Aceto Corp. of New Hyde Park, N.Y.). To improve wetting and flow of the ink, 0.4 percent by weight of flow agent (COATOSIL 3573 from Witco Corp. of Greenwich, Conn.) was added to the mixture. The final viscosity of the formulation at 25° C. was 15.2 mPas, when measured at shear rate of 100 $s^{-1}$ using the cup and bob geometry with the SR-200 control stress rheometer available from Rheomtric Scientific Inc. (Piscataway, N.J.) and the surface tension of the formulation was 23.5 mN/meter at 25° C. when measured using the plate method and Static surface tension was measured at room temperature using a Kruss K-10 tensiometer (available from Kruss GmbH of Hamburg Germany).

The following substrates were used:

| Sample | Description |
|---|---|
| A | 3M CONTROLTAC PLUS GRAPHIC SYSTEM 180-10 film, from 3M Company |
| B | 3M SCOTCHLITE REFLECTIVE SHEETING Series 510 retroreflective film, from 3M Company |
| C | 3M SCOTCHLITE Engineer Grade REFLECTIVE SHEETING Series 780 retroreflective film, from 3M Company |
| D | 3M CONTROLTAC PLUS GRAPHIC MARKING FILM WITH COMPLY ™ PERFORMANCE 3540C (SCREEN PRINTING) film, from 3M Company |
| E | 3M SCOTCHLITE DIAMOND GRADE LDP REFLECTIVE SHEETING 3970 retroreflective film, from 3M Company |
| F | 3M SCOTCHLITE HIGH INTENSITY SHEETING 3870 retroreflective film, from 3M Company |

Rows of single ink drops are deposited on substrates using an X-Y positionable platen. The printer had a print head (XAARJET XJ128-360, from XAAR Ltd. of Cambridge, UK) capable of printing ink drops having a volume of 30 pL. The size of the ink drop at the time when the ink impacts the substrate was calculated as the diameter of a perfect hemisphere having a volume of 30 pL. The dwell time for the first row of dots was 0.5 seconds. The dwell time for the following 15 rows of dots increased by intervals of eight seconds for each row. The diameter of the cured ink dots on each substrate for each interval of time was measured using a stereo microscope. The values set out below in Table I represent the average of six measurements using the stereo microscope and are graphically depicted in FIG. 3.

TABLE I

| | Diameter of ink dot in microns | | | | | |
|---|---|---|---|---|---|---|
| | Substrate | | | | | |
| Time, seconds | A | B | C | D | E | F |
| 0 | 54 | 54 | 54 | 54 | 54 | 54 |
| 0.5 | 112 | 109 | 87 | 91 | 115 | 119 |

TABLE I-continued

| | Diameter of ink dot in microns | | | | | |
|---|---|---|---|---|---|---|
| | Substrate | | | | | |
| Time, seconds | A | B | C | D | E | F |
| 8 | 118 | 131 | 96 | 102 | 127 | 131 |
| 16 | 125 | 139 | 95 | 99 | 128 | 148 |
| 24 | 128 | 148 | 98 | 102 | 131 | 157 |
| 32 | 126 | 155 | 92 | 107 | 138 | 168 |
| 40 | 129 | 168 | 89 | 103 | 139 | 171 |
| 48 | 132 | 167 | 95 | 100 | 134 | 176 |
| 56 | 134 | 169 | 99 | 103 | 135 | 172 |
| 64 | 137 | 176 | 101 | 105 | 133 | 178 |
| 72 | 138 | 178 | 100 | 106 | 137 | 181 |
| 80 | 135 | 187 | 97 | 105 | 138 | 183 |
| 88 | 136 | 191 | 98 | 107 | 141 | 189 |
| 96 | 134 | 184 | 100 | 106 | 139 | 188 |
| 104 | 138 | 190 | 95 | 108 | 138 | 188 |
| 112 | 139 | 188 | 102 | 107 | 140 | 189 |
| 120 | 140 | 195 | 102 | 108 | 140 | 190 |

Figure 3:
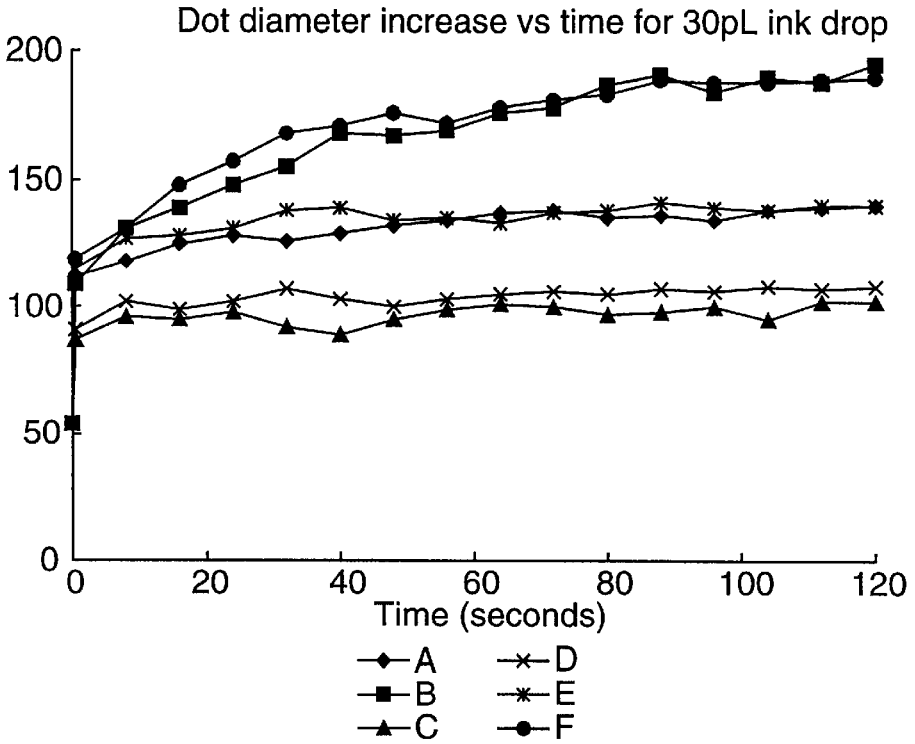
FIG. 3 is a graph showing exemplary increases in the diameter of ink dots on certain substrates when a particular ink and a particular print head are used.

As shown in FIG. 3, the size of the ink dot essentially reached a maximum size for samples C and D at a dwell time of about eight seconds. For samples A and E, the ink dot essentially reached a maximum size at a dwell time of around 30 seconds. For samples B and F, the ink dot essentially reached a maximum size at a dwell time of about 90 seconds.

EXAMPLE 2

Figure 4:
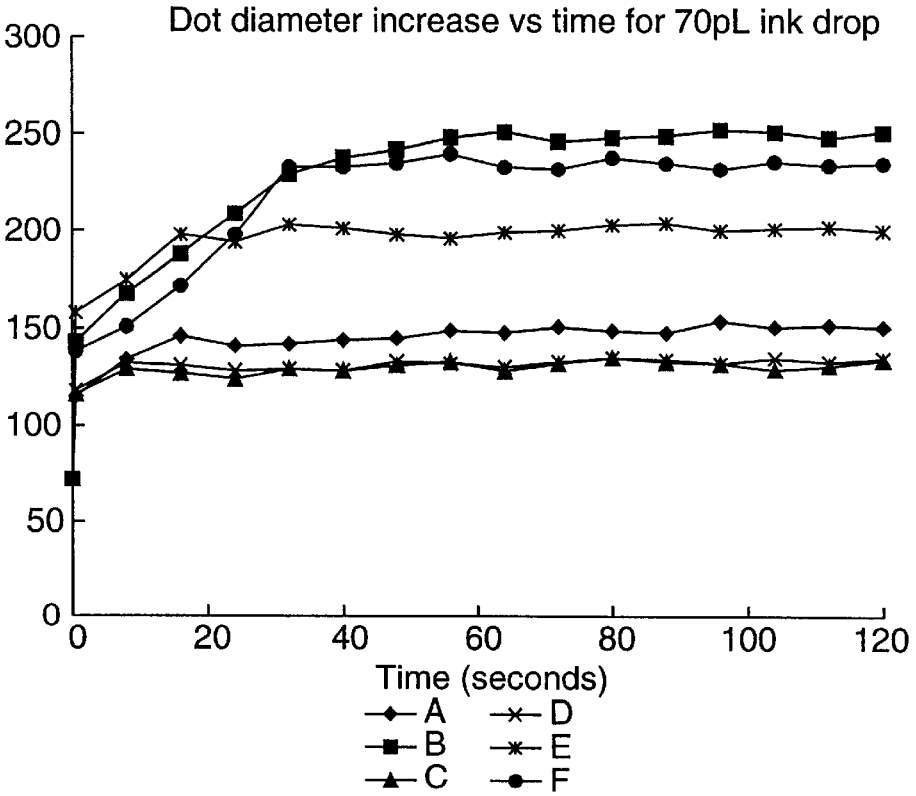
FIG. 4 is a graph somewhat similar to FIG. 3 except that a different print head is used to apply the ink drop to the substrate.

Example 1 was repeated using the same printer ink and substrates, but with a 70 pL print head (XAARJET XJ 128-200, from XAAR). The results are set out below in Table II and are graphically depicted in FIG. 4.

TABLE II

| | Diameter of ink dot in microns | | | | | |
|---|---|---|---|---|---|---|
| | Substrate | | | | | |
| Time, seconds | A | B | C | D | E | F |
| 0 | 72 | 72 | 72 | 72 | 72 | 72 |
| 0.5 | 115 | 143 | 116 | 118 | 158 | 138 |
| 8 | 134 | 168 | 129 | 132 | 175 | 151 |
| 16 | 146 | 188 | 127 | 131 | 198 | 172 |
| 24 | 141 | 209 | 124 | 128 | 194 | 198 |
| 32 | 142 | 229 | 129 | 129 | 203 | 233 |
| 40 | 144 | 238 | 128 | 128 | 201 | 233 |
| 48 | 145 | 242 | 131 | 133 | 198 | 235 |
| 56 | 149 | 248 | 133 | 132 | 196 | 240 |
| 64 | 148 | 251 | 128 | 130 | 199 | 233 |
| 72 | 151 | 246 | 132 | 133 | 200 | 232 |
| 80 | 149 | 248 | 135 | 135 | 203 | 238 |
| 88 | 148 | 249 | 133 | 134 | 204 | 235 |
| 96 | 154 | 252 | 132 | 132 | 200 | 232 |
| 104 | 151 | 251 | 129 | 135 | 201 | 236 |
| 112 | 152 | 248 | 131 | 133 | 202 | 234 |
| 120 | 151 | 251 | 134 | 135 | 200 | 235 |

The data show that the size of the ink dot essentially reached a maximum value for samples C and D at a dwell time of about eight seconds. The ink dot essentially reached a maximum value for substrates A and E when a dwell time of about 20 seconds is used. The ink dot printed on substrate F essentially reached a maximum size at a dwell time of about 30 seconds and the ink dot printed on substrate B appears to increase in size up to a dwell of about 60 seconds.

EXAMPLE 3

A theoretical minimum required dot gain for good solid fill was then calculated as a function of ink drop volume and printing resolution. Dot gain is defined as the ratio of final dot diameter on the substrate ("D") divided by the diameter of the ink drop before impacting the substrate ("d"). The printing resolution is defined as the number of dots per lineal inch. The final dot size diameter on the substrate, or "D", is related to the resolution of the printer (dpi), and for complete solid fill should be equal to the square root of 2 by the printer resolution, or $D=(2)^{0.5}/dpi$. The diameter of the drop before impacting the substrate, or d, as well as the theoretical minimum required dot gain for three different printer resolutions are shown in Table III.

TABLE III

| | | Gain | | |
|---|---|---|---|---|
| Volume, pL | Diameter, microns | 300 × 300 resolution | 360 × 360 resolution | 600 × 600 resolution |
| 10 | 26.7 | 4.48 | 3.73 | 2.24 |
| 20 | 33.7 | 3.56 | 2.96 | 1.78 |
| 30 | 38.6 | 3.11 | 2.59 | 1.55 |
| 40 | 42.4 | 2.82 | 2.35 | 1.41 |
| 50 | 45.7 | 2.62 | 2.18 | 1.31 |
| 60 | 48.6 | 2.46 | 2.05 | 1.23 |
| 70 | 51.1 | 2.34 | 1.95 | 1.17 |
| 80 | 53.5 | 2.24 | 1.87 | 1.12 |
| 90 | 55.6 | 2.15 | 1.79 | 1.08 |
| 100 | 57.6 | 2.08 | 1.73 | 1.04 |

It is preferred to multiply the theoretical value of dot gain by 1.25 to obtain a practical dot gain in order to allow for imperfections in print head performance such as cross-talk, non-uniform ink drop size, and misdirected ink drops. As such, the practical dot gain can be calculated for Examples 1 and 2 set out above.

EXAMPLE 4

Figure 5:
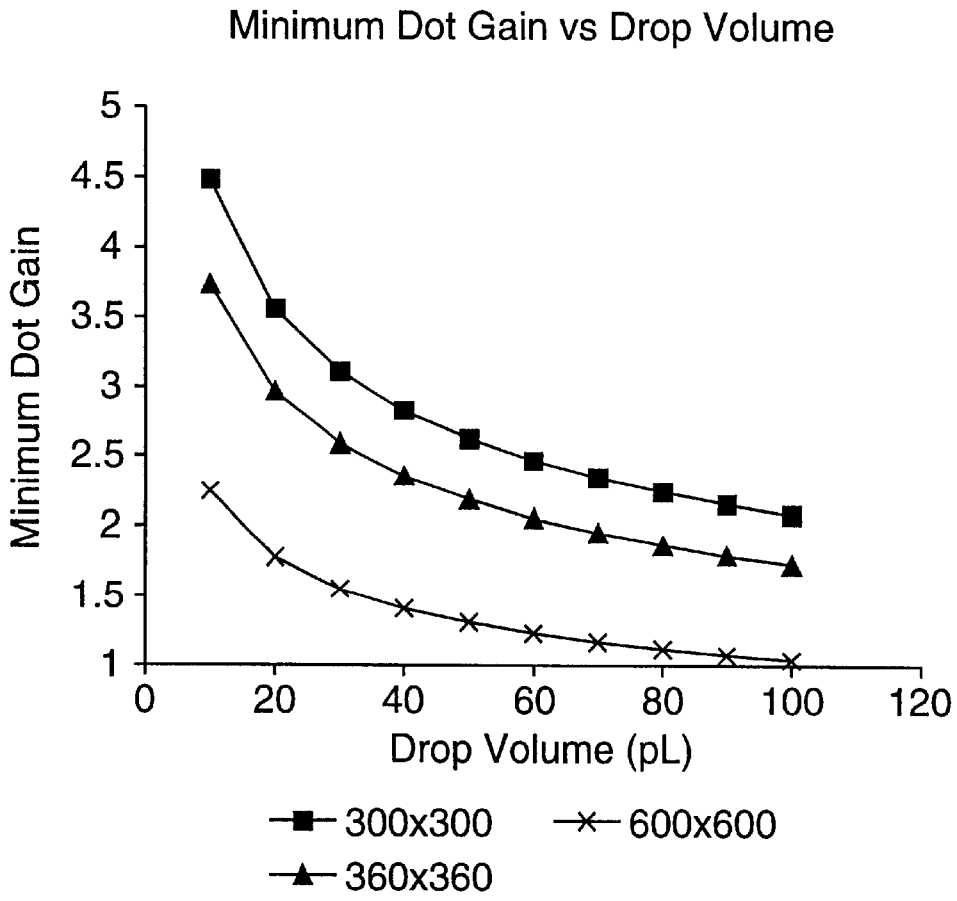
FIG. 5 is a graph depicting minimum gain of ink dots as a function of ink drop volume for three exemplary image resolutions.

At a desired image resolution of 300×300 dpi, and using.the printer as described in Example 1, the theoretical minimum dot gain as shown in FIG. 5 is about 3.1.

Consequently, the practical required dot gain is 3.9. The required dot size of the ink on the substrate can then be calculated by multiplying the diameter of the dot times the dot gain, or 148 microns.

Accordingly, an optimum dwell time for each of the particular combinations of ink and substrates described in Example 1 is:

| Substrate | Dwell Time |
|---|---|
| A | 30 seconds |
| B | 24 seconds |
| C | 8 seconds |
| D | 8 seconds |
| E | 30 seconds |
| F | 16 seconds |

It is noted that the ink dots on substrates A, C, D, and E did not reach the optimum dot size of 148 microns. The recommended dwell time above for these substrates corresponds to the time at which the ink dot achieved its maximum size. Curing at that time prevents the ink dots from coalescing and provides for optimized image quality for the ink/substrate/print head combination used.

EXAMPLE 5

At a desired image resolution of 300×300 dpi, and using the printer as described in Example 2, the theoretical minimum dot gain as shown in FIG. 5 is about 2.3.

Consequently, the practical required dot gain is 2.9. The required dot size of the ink on the substrate can then be calculated by multiplying the diameter of the dot times the dot gain, or 148 microns.

Accordingly, an optimum dwell time for each of the particular combinations of ink and substrates described in Example 2 is:

| Substrate | Dwell Time |
|---|---|
| A | 16 seconds |
| B | 1 second |
| C | 8 seconds |
| D | 8 seconds |
| E | 0.5 seconds |
| F | 6 seconds |

It is again noted that the ink dots on substrates C, and D did not reach the optimum dot size of 148 microns. The recommended dwell time above for these substrates corresponds to the time at which the ink dot achieved its maximum size. Curing at that time prevents the ink dots from coalescing and provides for optimized image quality for the ink/substrate/print head combination used.

In addition to the various embodiments described above, a number of other embodiments are also possible. Accordingly, the invention should not be deemed limited to the specific examples of printers and printing methods described above, but instead only by a fair scope of the claims that follow along with their equivalents.

What is claimed is:

1. Inkjet printing apparatus for radiation curable ink comprising:

a support for receiving a substrate;

a print head for directing radiation curable ink toward a substrate received on the support;

a curing device for directing radiation toward ink received on the substrate;

a controller having an input for receiving one or more characteristics of the substrate and one or more characteristics of the ink, the controller including a computer for determining a desired dwell time for the ink based on the characteristics of the substrate and the ink; and a control device connected to the controller for varying the dwell time in accordance with the desired dwell time determined by the computer.

2. Inkjet printing apparatus according to claim 1 wherein the support comprises a drum.

3. Inkjet printing apparatus according to claim 2 wherein the control device comprises a variable speed drive for moving the drum.

4. Inkjet printing apparatus according to claim 1 wherein the support comprises a bed having generally flat configuration.

5. Inkjet printing apparatus according to claim 4 wherein the control device comprises a drive for moving the curing device relative to the bed.

6. Inkjet printing apparatus according to claim 4 wherein the control device comprises a drive for moving the curing device relative to the print head.

7. Inkjet printing apparatus according to claim 6 wherein the drive also moves the curing device relative to the bed.

8. Inkjet printing apparatus according to claim 1 wherein the curing device is movable in directions toward and away from the print head in order to vary the dwell time.

9. Inkjet printing apparatus according to claim 1 wherein the control device comprises a transport system for relatively moving the substrate and the curing device.

10. Inkjet printing apparatus according to claim 9 wherein the apparatus is a roll-to-roll printer.

11. Inkjet printing apparatus according to claim 1 wherein the control device comprises a variable speed control connected to the print head for varying the speed of printing.

12. Inkjet printing apparatus according to claim 1 wherein the controller includes a user interface for receiving characteristics of a desired image.

13. Inkjet printing apparatus according to claim 12 wherein the characteristics include one or more of the following: ink drop size, image resolution, image gloss, image color density.

14. Inkjet printing apparatus according to claim 1 wherein the controller includes a memory that retains one or more characteristics of certain substrates.

15. Inkjet printing apparatus according to claim 1 wherein the controller includes a memory that retains one or more characteristics of certain inks.

16. Inkjet printing apparatus according to claim 1 wherein the controller includes a memory that retains a preferred dwell time when a combination of certain ink and a certain substrate is used.

17. A method of inkjet printing comprising:

selecting a radiation curable ink;

selecting a substrate;

entering at least one characteristic of the ink and at least one characteristic of the substrate into a computer;

determining a preferred ink dot gain when the selected ink is printed onto the selected substrate; and calculating with the computer a dwell time for achieving the preferred ink dot gain.

18. A method of inkjet printing according to claim 17 and including the act of entering at least one characteristic of a desired image resolution into the computer.

19. A method of inkjet printing according to claim 17 and including the act of retaining in computer memory at least one characteristic of certain substrates.

20. A method of inkjet printing according to claim 17 and including the act of retaining in computer memory at least one characteristic of certain inks.

21. A method of inkjet printing according to claim 17 and including the act of retaining in computer memory a preferred dwell time when a certain ink and a certain substrate are used.

22. A method of inkjet printing according to claim 17 and including the act of selecting a velocity of relative movement between the substrate and a print head.

23. A method of inkjet printing according to claim 17 and including the act of relatively moving a print head and a curing device in accordance with the calculated dwell time.

24. A method of inkjet printing according to claim 17 and including the act of selecting a velocity of the substrate in accordance with the calculated dwell time.

25. A method of inkjet printing according to claim 17 and including the act of selecting a relative speed between the substrate and a print head in accordance with the calculated dwell time.

* * * * *

UNITED STATES PATENT AND TRADEMARK OFFICE

CERTIFICATE OF CORRECTION

PATENT NO. : 6,550,906 B2
DATED : April 22, 2003
INVENTOR(S) : Ylitalo, Caroline M.

It is certified that error appears in the above-identified patent and that said Letters Patent is hereby corrected as shown below:

Column 12,
Line 7, insert -- divided -- following "2"

Signed and Sealed this

Thirtieth Day of September, 2003

JAMES E. ROGAN
*Director of the United States Patent and Trademark Office*